US005522731A

United States Patent [19]

Clark et al.

[11] Patent Number: 5,522,731

[45] Date of Patent: Jun. 4, 1996

[54] SHIELDED CABLE CONNECTOR

[75] Inventors: William C. Clark; James R. Volstorf; Clifford L. Winings, all of Lee's Summit, Mo.

[73] Assignee: Berg Technology, Inc., Reno, Nev.

[21] Appl. No.: 242,499

[22] Filed: May 13, 1994

[51] Int. Cl.[6] ..... H01R 13/658

[52] U.S. Cl. ..... 439/108; 439/608

[58] Field of Search ..... 439/607–609, 439/108, 101

[56] References Cited

U.S. PATENT DOCUMENTS

| | | | |
|---|---|---|---|
| 3,587,028 | 6/1971 | Uberbacher | 439/608 |
| 4,501,461 | 2/1985 | Anhalt | 439/607 |
| 4,611,867 | 9/1986 | Ichimura et al. | 439/608 |
| 4,869,677 | 9/1989 | Johnson et al. | 439/80 |
| 4,903,402 | 2/1990 | Norton et al. | 29/843 |
| 5,040,999 | 8/1991 | Collier | 439/108 |
| 5,080,597 | 1/1992 | Seidel et al. | 439/108 |
| 5,288,247 | 2/1994 | Kaufman | 439/607 |

OTHER PUBLICATIONS

S. M. Ambekar, W. E. Hamilton and T. E. Cole, "Systems Packaging," *AT&T Technical Journal*, vol. 66, Issue 4, (Jul./Aug. 1987), pp. 81–95.

*Primary Examiner*—Gary F. Paumen

*Attorney, Agent, or Firm*—Daniel J. Long; M. Richard Page

[57] ABSTRACT

Proposed is a connector assembly for electrically coupling a shielded cable to a ground plane. The assembly includes a metal shroud with pins for press-fitting to the ground plane, and a plug with a shield connection clamped or taped to the cable shield. Ground connections are provided by two paths: one from the drain wire of the cable through a signal contact in the plug and the other through the shield connection and shroud. Spacers in the shroud provide a keying function while permitting end-to-end stacking of plugs. Latching features on the plug and shroud hold the plugs in position and prevent insertion of the plug in the wrong orientation. Heat stakes in the plug can be used for the latching feature.

14 Claims, 5 Drawing Sheets

SHIELDED CABLE CONNECTOR

BACKGROUND OF THE INVENTION

This invention relates to a connector assembly for electrically coupling a shielded cable to a ground plane.

In a typical interconnection system, circuit packs with connectors on one edge are electrically coupled to pins emerging from a backplane. Cables are also electrically coupled to pins emerging from the opposite surface of the backplane. (See, e.g., *AT&T Technical Journal*, Vol. 66, pp. 81–95 (July/August 1987).) In the case of cables with electromagnetic interference (EMI) shielding, the cable shield is typically coupled to designated pins in the backplane which are, in turn, coupled to a ground plane on the backplane surface. While such a ground connection is adequate for most applications, in the case of high frequency signals, problems can arise if the transfer impedance of the shield connection is not sufficiently low. Shield connections that do not have low enough transfer impedance can result in unacceptable high levels of electromagnetic emissions from the cable or unacceptable susceptibility to external sources of electromagnetic radiation. In addition to a ground path for the shield which is a part of the cable, cable connectors may also require an ability to be stacked end-to-end and some sort of keying function which prevents insertion of the plug in the wrong position.

Metal shrouds have been proposed for ground connection of a variety of connectors to circuit boards (see, e.g., U.S. Pat. No. 4,903,402 issued to Norton et al., U.S. Pat. No. 5,040,999 issued to Collier, and U.S. Pat. No. 5,288,247 issued to Kaufman).

It has also been suggested in providing connection of daughter boards to backplanes to include a ground or power contact in the side wall of a shroud mounted to the backplane (see U.S. Pat. No. 4,869,677 issued to Johnson et al.).

SUMMARY OF THE INVENTION

The invention is an electrical connector comprising a shroud with metal side walls and conductive pins extending therefrom for press-fitting into holes in a board. The shroud includes contacts on inside surfaces of the side walls adapted for making electrical contact with a shield surrounding a plug. A plurality of conductive plates are attached essentially perpendicular to the side walls in order to provide shielded compartments for more than one plug.

It will be appreciated that for purposes of illustration, these figures are not necessarily drawn to scale.

DETAILED DESCRIPTION

Figure 3:
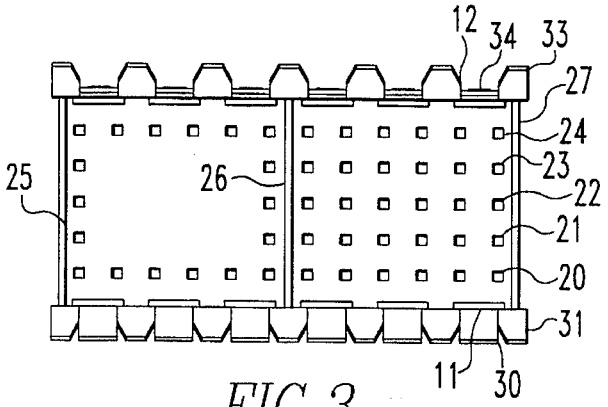
FIG. 3 is a top view of the shroud of FIG. 1.
Figure 1:
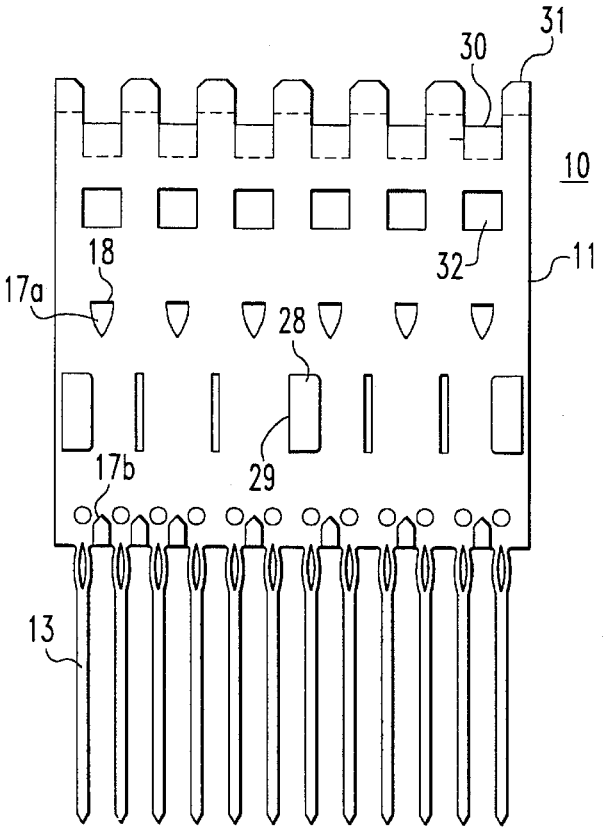
FIG. 1 is a front view of a connector shroud in accordance with an embodiment of the invention.
Figure 2:
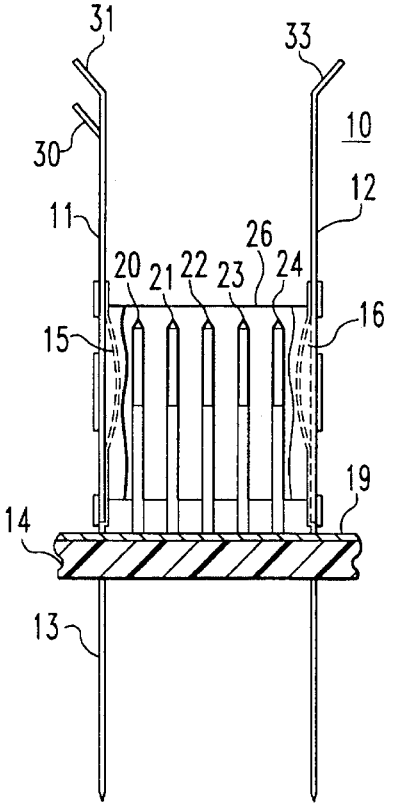
FIG. 2 is a partially cut-away side view of the shroud of FIG. 1.

FIGS. 1–3 illustrate various views of a shroud, 10, in accordance with an embodiment of the invention. The shroud includes a pair of side walls, 11 and 12, which are made of a metal such as copper alloy. Integral with each side wall, e.g.,11, is a plurality of compliant press-fit conductive pins, e.g., 13, which extend from the bottom of the side walls. The pins are of a type well-known in the art, and have compliant sections such as eye-of-needle sections, which can be press-fit within plated via holes in a standard backplane 14. (The backplane is not shown in FIG. 1 to illustrate the full length of the pins.) The pins, e.g., 13, make electrical contact with a ground plane 19 which is typically formed on the surface of the backplane 14, but can be internal thereto. Each side wall further includes a plurality of spring contacts, e.g., 15 and 16, attached on the inside surface of the wall. Each spring contact in this example is secured to the side wall by tabs, e.g., 17*a* and 17*b*. Tab 17*a* is inserted within a corresponding hole, e.g., 18, in the wall and tab 17*b* is wrapped around the bottom of the side wall, e.g., 11.

Within the boundaries of the side walls, 11 and 12, is an array of conductive pins, e.g., 20–24. These pins may be mounted within an insulating base of the shroud 10, and inserted within corresponding holes in the backplane 14 when the outer pins, e.g, 13, are inserted in the backplane. Alternatively, the pins 20–24 may be formed independently and inserted into the backplane separately from the shroud 10, or may be pans of another connector that is installed on the opposite side of the backplane. These conductive pins are inserted into through-holes in the backplane which are generally insulated from the ground plane, 19, with the exception of specified pins as discussed below.

Also mounted to the side walls 11 and 12 are conductive plates 25, 26 and 27, which are typically made of metal such as stainless steel. As shown, these plates extend essentially perpendicular to the side walls and are attached thereto by tabs, e.g., 28, which extend through corresponding slots, e.g., 29. As shown in FIG. 2, the plates extend from the surface of the backplane 14 to a height just above the internal pins, e.g., 20–24.

The upper edge of side wall 11 is formed into a series of first flared-out portions, e.g., 30, which can be separated by second flared-out portions, e.g., 31, of a greater height. Each first flared-out portion, e.g., 30, is vertically aligned with a corresponding square hole, e.g., 32, formed in the side wall. The upper edge of the opposite side wall 12 includes a series of third flared-out portions, e.g., 33, which are horizontally aligned with corresponding second flared-out portions, e.g., 31, on the other side wall 11. The third flared-out portions, e.g., 33, are separated by horizontal ledge portions, e.g., 34. These ledge portions are horizontally aligned with corresponding first flared-out portions, e.g., 30, on the other side wall 11.

Figure 6:
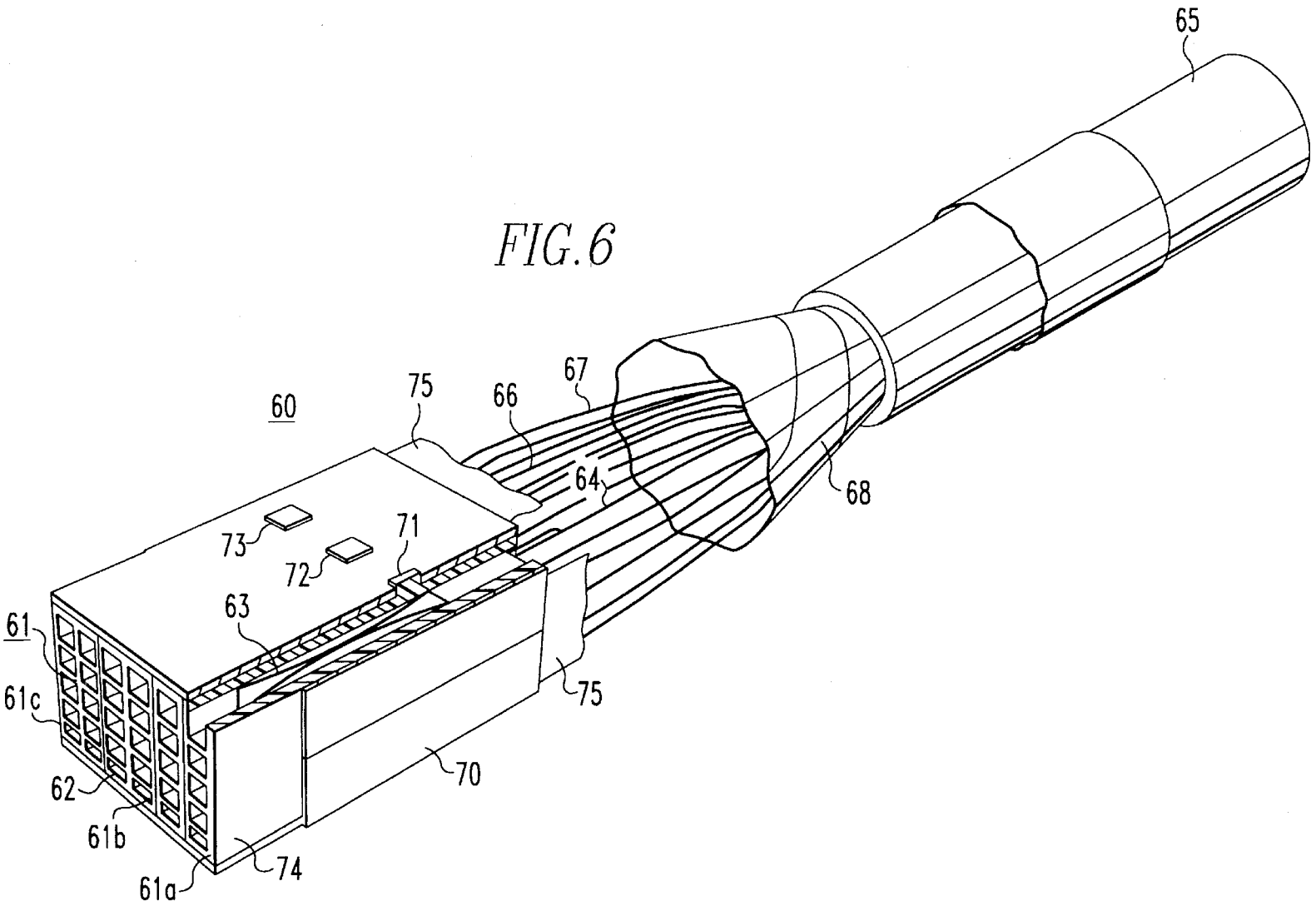
FIG. 6 is an exploded view of the plug coupled to a cable which is shown in FIGS. 4 and 5.

The shroud 10 is adapted to receive within the side walls, 11 and 12, a plug which is electrically coupled to a cable so that the plug makes electrical contact with the pins, e.g., 20–24, within the shroud. One example of such a plug 60 is illustrated in FIG. 6. The plug includes an insulating housing 61 which has a plurality of receptacles, e.g., 62. In this example, the housing 61 is made from a plurality of separate modules, 61*a*, 61*b*, and 61*c*. Each module has two rows of receptacles as shown. Alternatively, a single module can be used. Each receptacle includes therein a standard contact 63, which has a pair of tynes on one end for contacting one of the pins in the shroud, and a termination region on the other end. Each termination region is electrically coupled to one of the wires, e.g., 64, which are pan of the cable 65. The cable wires, e.g., 64, 66 and 67, are surrounded by a conductive foil 68 within the outer jacket of the cable. The signal wires, e.g., 66 and 67, are electrically insulated from the foil. However, one or more drain wires, e.g., 64, are electrically coupled to the foil 68 to carry any currents generated in the foil by radiation from the signal wires.

Most of the area of the plug housing 61 is surrounded by a metal shield 70. The shield 70 and the modules 61*a*, 61*b* and 61*c* are held in place by heat stakes, e.g., 71–73. The heat stakes protrude significantly from the surface of the housing on one side of the plug. Besides the front surface of the plug which includes the apertures for receiving the pins from the shroud, portions, e.g., 74, of the side surfaces of the plug will also be uncovered by the shield 70. These uncovered portions have a length which will accommodate the spacer plates, 25–27 of FIGS. 13, when the plug is fully inserted into the shroud. The shield 70 is electrically coupled to the foil 68 by means of flaps 75, one or more of which extend from the shield 70 and make mechanical and electrical contact with the foil 68. These flaps can be locked together with tabs (not shown). Further, conductive tape (not shown) can be wrapped around the flaps 75 to increase the reliability of the electrical connection.

Figure 4:
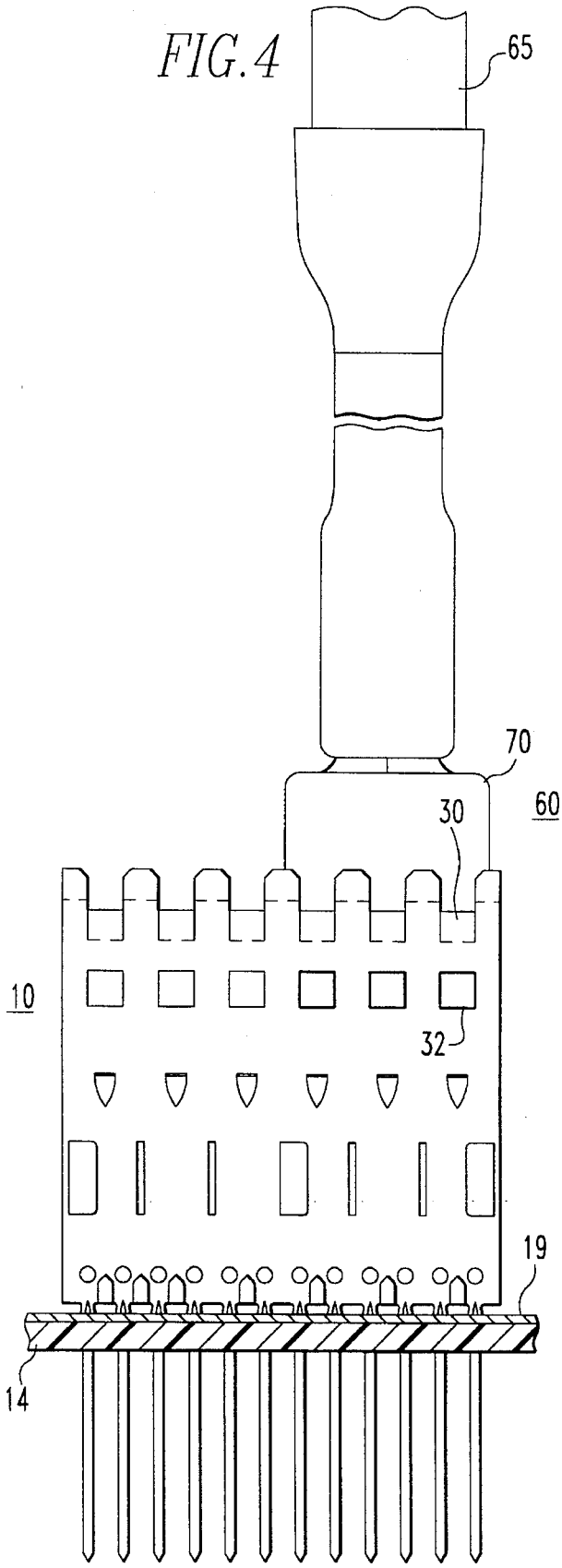
FIG. 4 is a front view of the shroud of FIG. 1 with a cable plug inserted therein.
Figure 5:
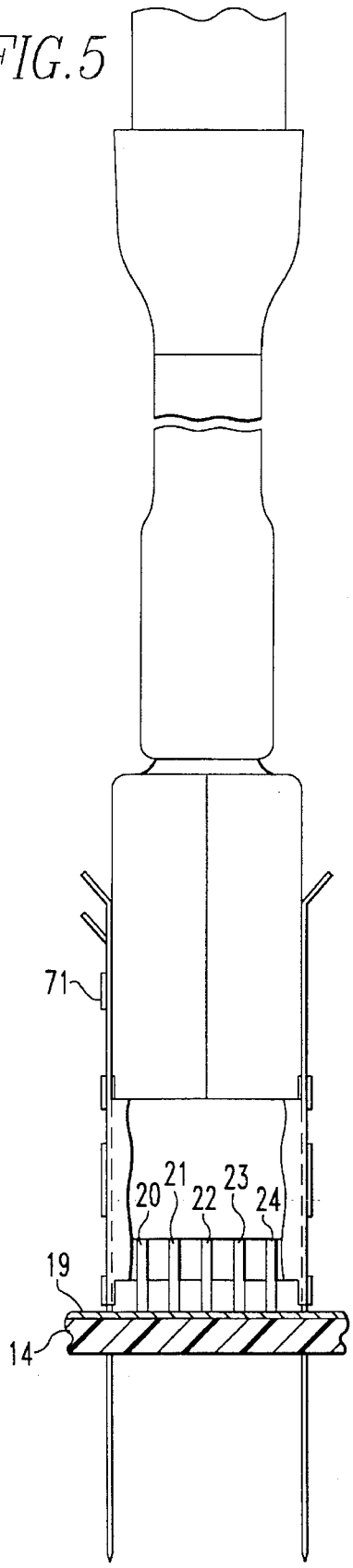
FIG. 5 is a side view of the shroud of FIG. 1 with the same plug inserted therein.

FIGS. 4 and 5 illustrate the insertion of the plug 60 into the shield 10 for providing electrical contact with the internal pins, e.g., 20–24. When the plug is initially inserted, the front of the plug will be guided by the second flared-out portions, e.g., 31, to center the plug on the shroud and pin field. The beveled ends of the second flared-out portions will align the heat stakes with the first flared-out portions, e.g., 30. The heat stakes, e.g., 71, will push against the first flared-out portions, e.g., 30, to spread the side wall 11 of the shroud. When the plug housing is fully inserted over the desired portions of the pins, e.g., 20–24, the heat stakes, e.g., 71, will protrude through the corresponding square holes, e.g., 32, in side wall 11 of the shroud to provide a latching function.

When the plug 60 is fully inserted within the shroud 10, the shield 70 will be mechanically and electrically contacted by the spring contacts, e.g., 15 and 16. Also, the spacer plates, e.g., 26 and 27, will extend up the side surfaces of the plug to cover the portions of the plug, e.g., 74 of FIG. 6, which were not covered by the shield 70.

It will be noted, therefore, that several important functions are provided by the shroud 10 in combination with the plug 60. The foil 68 of the cable will be electrically connected to a ground plane 19 in the backplane 14 through the shield 70 and the pins, e.g., 13, which are an integral part of the side surfaces of the shroud. This ground connection is designed to conduct high frequency components. In addition, a second ground path is provided by means of the drain wires, e.g., 64, of the cable through selected contacts, e.g., 63, of the plug which are electrically coupled to designated pins, e.g., 20, which are internal to the shroud and which are coupled to the ground plane 19. This second path provides reliable connection for DC and low frequency signals.

It should also be appreciated that the spacer plates, e.g., 26 and 27, result in the plug being completely surrounded by a ground connection, i.e., the combination of shield 70 and spacer plates, when fully inserted. However, there is also sufficient space to allow plugs to be stacked end-to-end in the shroud since a single plate, e.g., 26, in the interior will act as a portion of the shield for two adjacent plugs.

Figure 7:
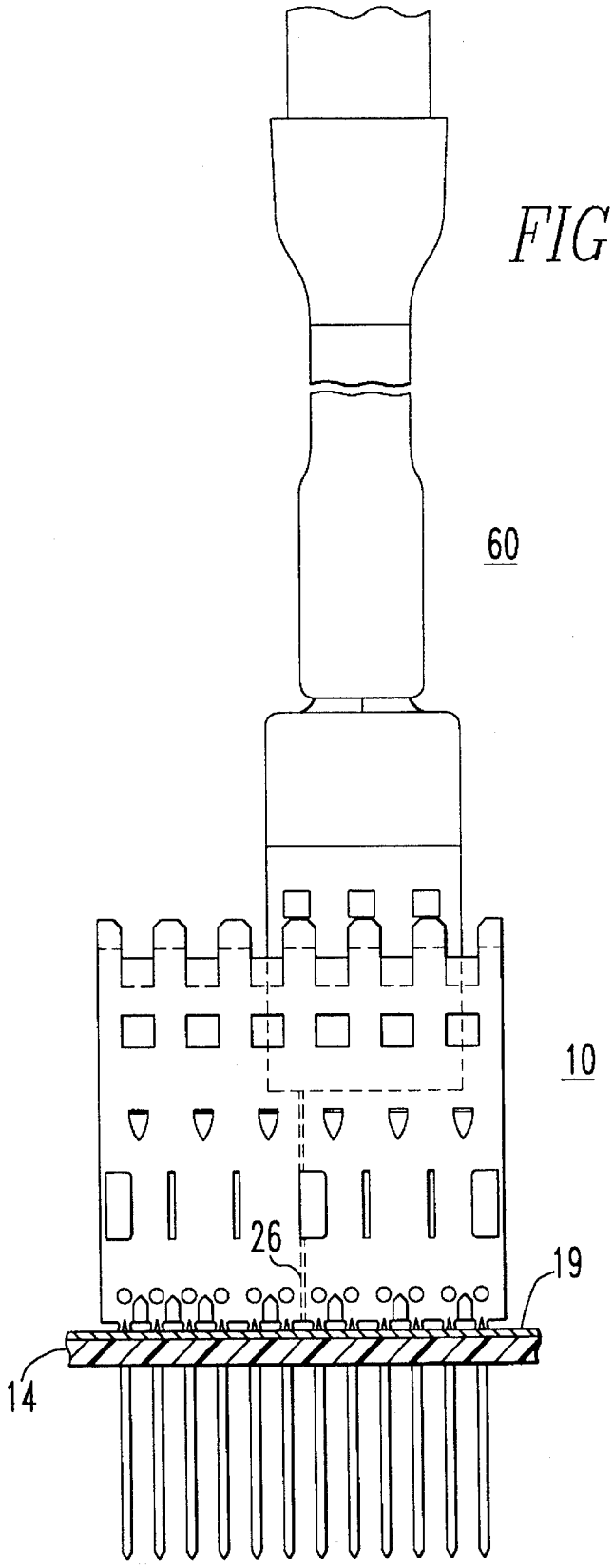
FIG. 7 is a front view of the shroud and plug of FIGS. 4 and 5 illustrating a feature of the invention.

The spacer plates, 25–27, also perform a keying function as illustrated in the view of FIG. 7. That is, if an attempt is made to insert the plug 60 misaligned with the rows of internal pins, the insertion will be blocked by the plug housing hitting one of the plates, e.g., 26, in this example.

Figure 8:
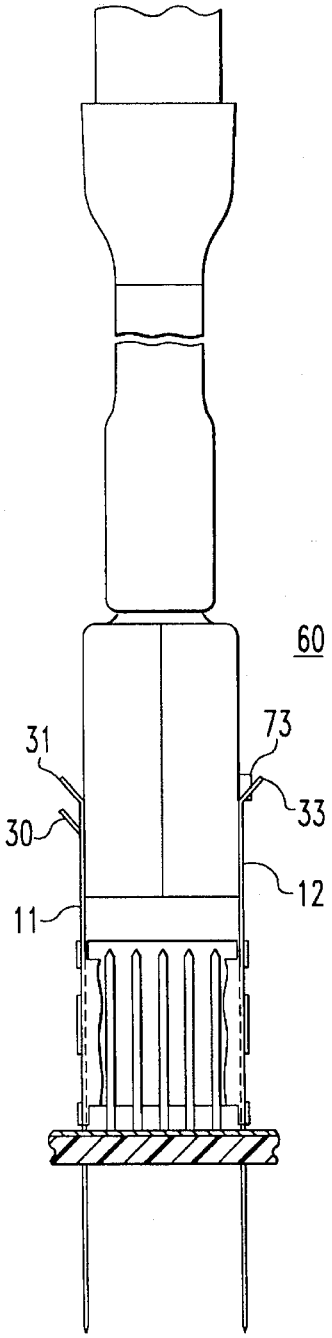
FIGS. 8 and 9 are side and front views, respectively, of the shroud and plug of FIGS. 4 and 5 illustrating a further feature of the invention.
Figure 9:
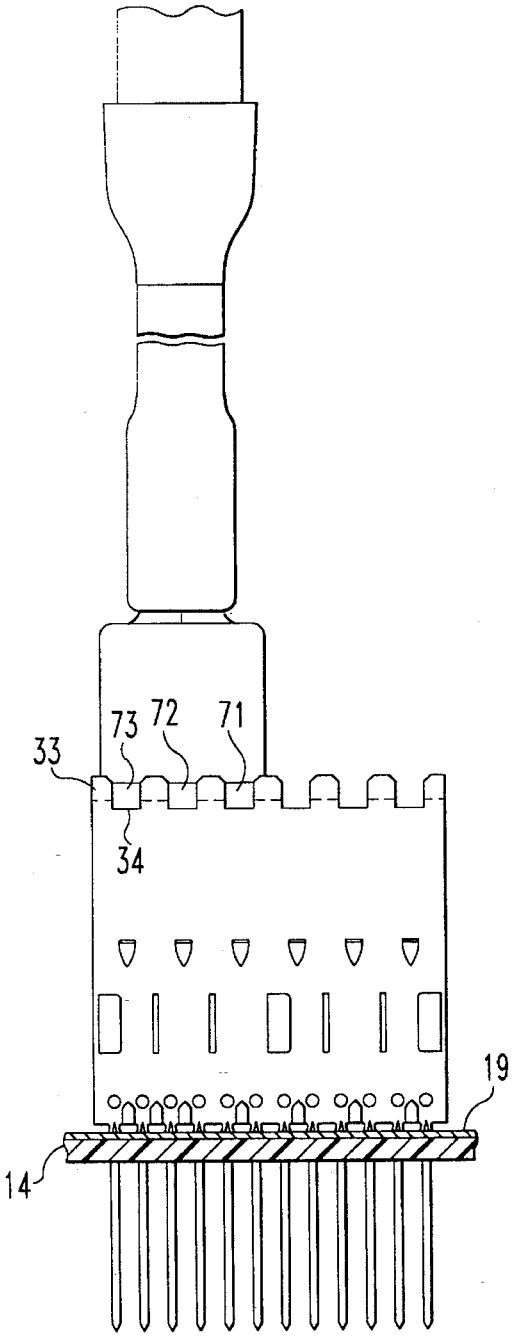

A further type of keying operation is performed by the combination of shroud side walls 11 and 12 and heat stakes 71–73. The heat stakes are made to protrude from only one major surface of the plug housing so as to spread the walls of the shroud and fall within the square holes, e.g, 32, of one side wall, e.g., 11, when properly inserted. If an attempt is made to insert the plug at a 180 degree rotation from the proper orientation, as illustrated in FIGS. 8 and 9, the heat stakes will strike the ledges, e.g., 34, between the flared-out portions of the opposite side wall 12, and the plug will not be inserted. Thus, proper polarization is maintained.

Various modifications of the invention will become apparent to those skilled in the art. All such variations which basically rely on the teachings through which the invention has advanced the art are properly considered within the scope of the invention.

We claim:

1. An electrical connector suitable for press-fitting into holes in a board comprising:

a shroud with metal side walls and conductive pins extending therefrom, the shroud further including contacts on inside surfaces of the side walls adapted for making electrical contact with a shield surrounding a plug, and essentially perpendicular to the side walls in order to provide shielded compartments for more than one plug, wherein a top edge of one of the side walls comprises a first array of flared-out portions separated by a second array of flared-out portions.

2. The connector according to claim 1 wherein a top edge of the other side wall includes a third array of flared-out portions separated by horizontal ledges, the ledges being aligned with the first array of flared-out portions.

3. The connector according to claim 2 wherein said one of said side walls includes a plurality of holes for receiving latching elements therein, the holes being vertically aligned with the said first array of flared-out portions.

4. The connector according to claim 1 further comprising an array of conductive pins between the two side walls and making electrical connection to the board to which the shroud is mounted.

5. The connector according to claim 4 wherein the conductive plates extend from a surface of the board to a height above the array of conductive pins.

6. The connector according to claim 5 further comprising a plug connector electrically coupled to a cable, the plug connector comprising an insulating housing at least partially surrounded by a conductive shield, the plug being adapted to fit within the shroud so that the contacts on the inside surfaces of the side walls make electrical contact with the shield.

7. The connector according to claim 6 wherein the housing has a front surface with apertures therein and a plurality of contacts aligned with the apertures for receiving and making electrical contact with a plurality of conductive pins mounted between the two side walls of the shield.

8. The connector according to claim 7 wherein the housing further includes side surfaces, with the shield covering substantially all but a lower portion of two opposite side surfaces such that the conductive plates of the shroud cover said lower portions when the plug is inserted in the shroud.

9. The connector according to claim 8 wherein the cable includes at least one drain wire which is coupled to a designated one of said contacts in the housing such that the plug and shroud provide two separate ground connection paths.

10. The connector according to claim 9 wherein the plug housing includes a plurality of heat stakes protruding from one side surface thereof and adapted to fit within holes in one of the side walls of the shroud.

11. The connector according to claim 10 wherein the insulating housing comprises a plurality of separate modules which are held together.

12. The connector according to claim 1 wherein the contacts are separate spring contacts attached to the side walls.

13. The connector according to claim 1 further comprising an array of conductive pins between the two side walls and making electrical connection to the board to which the shroud is mounted.

14. The connector according to claim 13 wherein the conductive plates extend from a surface of the board to a height above the array of conductive pins.

* * * * *